United States Patent [19]

Footer

[11] 4,413,625

[45] Nov. 8, 1983

[54] BRASSIERE CONSTRUCTION

[76] Inventor: Marvin P. Footer, 2713 Unicorn La., NW., Washington, D.C. 20015

[21] Appl. No.: 342,888

[22] Filed: Jan. 26, 1982

[51] Int. Cl.[3] ..... A41C 3/00; A41C 1/00

[52] U.S. Cl. ..... 128/425; 128/483; 128/497; 128/578

[58] Field of Search ..... 128/425, 516, 497, 578, 128/483

[56] References Cited

U.S. PATENT DOCUMENTS

| | | | |
|---|---|---|---|
| 1,359,346 | 11/1920 | Fields | 128/578 |
| 1,516,658 | 11/1924 | Zwiebelson | 128/483 |
| 1,963,373 | 6/1934 | Nelson | 128/497 |
| 1,971,113 | 8/1934 | Maier | 128/516 |

FOREIGN PATENT DOCUMENTS

| | | | |
|---|---|---|---|
| 71846 | 12/1950 | Denmark | 128/483 |

*Primary Examiner*—Doris L. Troutman
*Attorney, Agent, or Firm*—Harvey B. Jacobson

[57] ABSTRACT

A brassiere construction in which an upward pulling force and laterally inwardly pulling force or compression is applied to the outer portion of the breast to provide a brassiere which obtains more effective support of the breast and a better fit with the breast actually being supported laterally and pulled upwardly laterally to provide a more effective support both anatomically and physiologically. The brassiere construction is conventional except for the construction of the upper edge portion of the chest encircling supporting band being shortened by approximately one inch as compared to conventionally provided brassiere bands with the cups and shoulder straps being conventional and the fastening device connecting the ends of the band together also being conventional and the band is attached to the lateral outer edge of the breast cups in a conventional manner with the shortening of the upper portion of the brassiere band serving to create and cause upward and lateral pressure against the outer part of the breast when the shoulder straps are adjusted thus effectively supporting and fitting the breasts and providing a lateral and upward pull and snug compression of the brassiere cup and adjacent portion of the brassiere band with the outer lateral portion of the breast which has a tendency to become positioned under the upper and lateral edge portion of the breast cups and support band.

6 Claims, 4 Drawing Figures

BRASSIERE CONSTRUCTION

BACKGROUND OF THE INVENTION

1. Field of the Invention

The present invention generally relates to a brassiere construction and more particularly to a brassiere having a novel and unique support band in which the upper portion of the support band is constructed with a length shorter than conventional to increase supporting engagement of the outer portions of the breast adjacent its juncture with the chest cavity with adjustment of the shoulder straps and the shorter upper portion of the support band providing lateral and upward supporting pull or tension on the breast cup and also orienting the outer upper portion of the breast cup and adjacent portions of the supporting band in snug compressive relation to the outer upper portion of the breast and adjacent muscle tissue and the like to provide a better fit and more effective support for the breast, particularly the outer lateral portions of the breast adjacent those portions thereof continuous with the chest area.

2. Description of the Prior Art

Various types of brassieres have been commercially available for many years but even though many developments have been made, one of the continuing existent problems resides in the inadequate support for the lateral outer portions of the breast where the breast tissues connect with the chest area resulting in this portion of the breast sometimes becoming lodged between the inner and laterally outer edge portion of the breast cup and adjacent portions of the support band and the chest wall or cavity thereby resulting in inadequate support for the breast. The following U.S. patents are exemplary of the prior art in this field.

U.S. Pat. No.1,824,613 Middleton September 1931;

U.S. Pat. No. 2,239,056 Schiffer April 1941; U.S. Pat. No. 2,517,287 Corbeil August 1950;

U.S. Pat. No. 2,703,886 Lo Cascio March 1955;

U.S. Pat. No. 2,706,816 Dozier April 1955;

U.S. Pat. No. 2,887,113 Gingras May 1959;

U.S. Pat. No. 3,411,510 Child November 1968;

U.S. Pat. No. 3,467,105 White September 1969.

SUMMARY OF THE INVENTION

An object of the present invention is to provide a brassiere construction having the unique and novel supporting band attached to the outer lateral edge portions of the breast cups in a conventional manner with the support band including a shorter upper portion which cooperates with the remainder of the brassiere including the shoulder straps to provide a lateral, upward, circumferential and radially inward force in order to more adequately fit and better support the lateral outer portions of the breast particularly in the area where the laterally outer breast tissues connect with the adjacent portions of the chest area.

Another object of the invention is to provide a brassiere construction in which the support band is constructed approximately one inch shorter than commercially available and conventional brassieres to provide more effective fit and support anatomically and physiologically by providing a lateral and upward pull and a circumferential and radially inward pull on the outer edge portion of the breast cup thereby more effectively fitting the breast cup to the breast and more effectively supporting the breast cup with the outer edge thereof being pulled laterally, upwardly, circumferentially and radially inwardly so that the outer edge portion of the breast cup snugly fits, embraces and supports that portion of the outer surface of the breast where the breast tissues connect with the chest area.

A further object of the invention is to provide a brassiere construction in which the concept of shortening the upper edge portion of the support band eliminates the use of resilient structures which exert a constant tension or force on the support band which introduces an objectional continuous and variable force on the breast with the present invention incorporating a fixed length without introduction of resilient elements but the fixed length is shorter than conventional brassieres so that by proper adjustment of the overall length of the support band and the shoulder straps, optimum support and fit is provided for the breast.

Yet another object of the invention is to provide a brassiere construction in which the shorter length concept for the upper portion of the support band may be incorporated into new brassiere structures or existing brassiere constructions may be modified to provide the desired resultant structure with the brassiere structure being relatively simple and inexpensive and being constructed of conventional materials by using conventional procedures with the improvement residing in the shorter length of the upper edge portion of the support band.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF A PREFERRED EMBODIMENT

Figure 1:
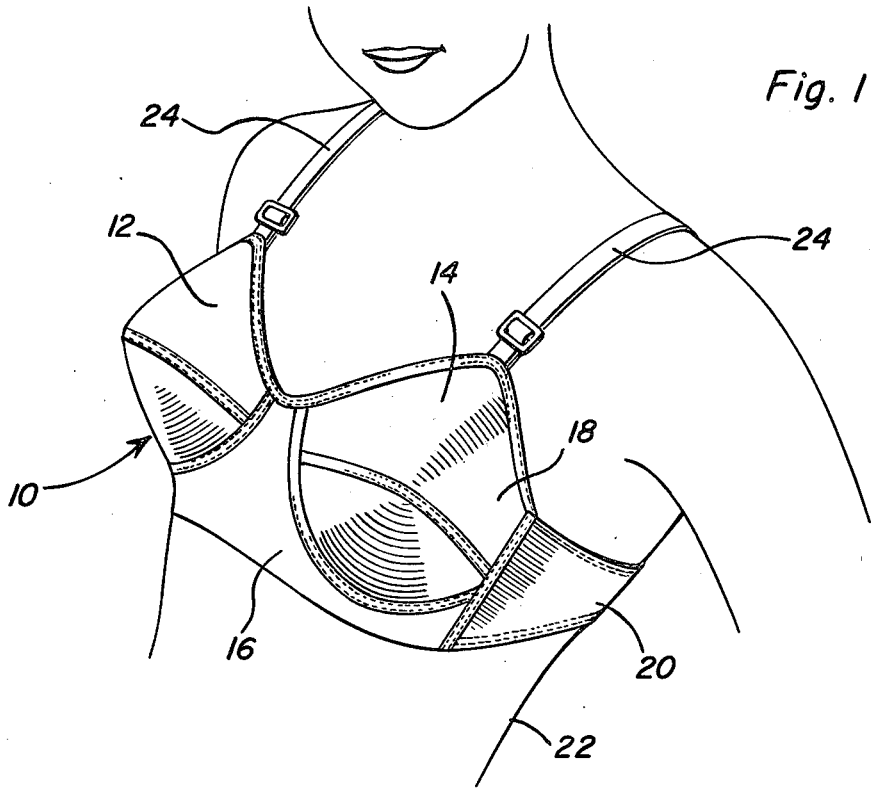
FIG. 1 is a perspective view of the brassiere construction of the present invention.
Figure 2:
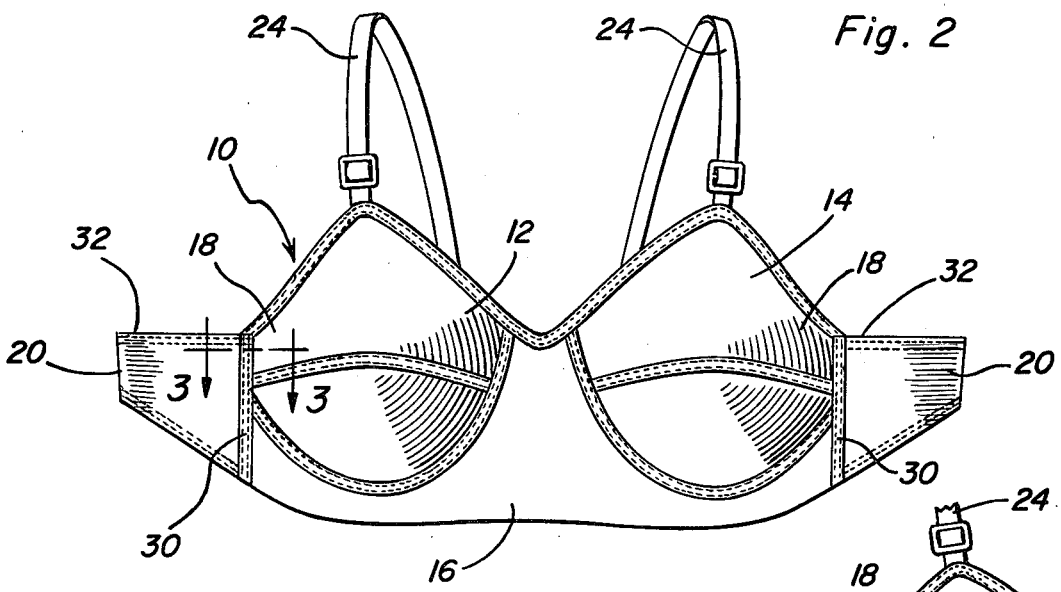
FIG. 2 is a front elevational view of the brassiere.
Figure 3:
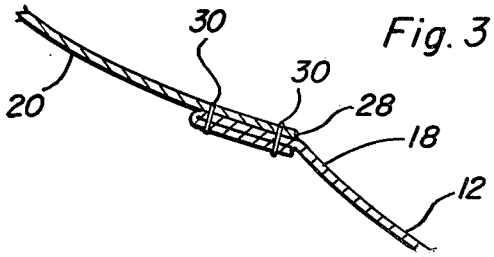
FIG. 3 is a sectional view taken substantially upon a plane passing along section line 3—3 of FIG. 2 illustrating the conventional manner of attaching the support band to the outer edge portion of the brassiere cup.

The brassiere construction of the present invention is generally designated by reference numeral 10 and includes a pair of breast cups 12 and 14 connected by and attached to a front panel or body portion 16 in a conventional and well known manner with the breast cups 12 and 14 also being conventional. The laterally outer edge portion 18 of each breast cup 12 and 14 and the outer edge portion of the front panel or body portion 16 is connected to a support band 20 which extends around the chest area 22 of the wearer and is provided with conventional fastener arrangements at the free ends in a conventional and well known manner. Also, adjustable shoulder straps 24 are attached to the upper edges of the breast cups 12 and 14 in a conventional manner with the rearward ends of the shoulder straps 24 being connected to the support band 20 adjacent the connected ends thereof in a well known manner and insofar as the aforedescribed structure is concerned, it is conventional and may be constructed of various conventional materials and in different sizes and styles depending upon the desires of individual wearers.

Figure 4:
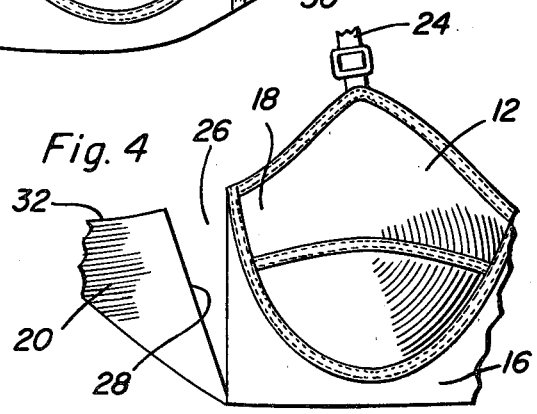
FIG. 4 is a fragmental elevational view illustrating the manner in which the support band has been shortened by providing the end of the support band with a bias cut before it is attached to the edge of the breast cup with that portion that has been shortened being generally V-shaped.

In constructing the brassiere of the present invention, the upper edge portion of the support band 20 is shortened by the length designated by the V-shaped area 26 illustrated in FIG. 4 with the end of the support band 20 being cut or formed in an inclined manner or on the bias as indicated by numeral 28 so that when the edge 28 of the support band 20 is connected to the adjacent edge portion 18 of the breast cup 12 and the body portion 16 by conventional stitching 30, the upper edge of the support band 20 will be shortened as compared to conventional length by approximately one inch with the adjacent portions of the support band 20 being correspondingly shortened a lesser distance. With the shortened construction of the upper edge portion 32 of the support band, adjustment of the shoulder straps 24 combined with adjustable connection of the ends of the support band 20 in a conventional manner will result in a better fit and more effective support anatomically and physiologically. The shortening of the support band 20 at the upper edge portion 32 results in an inward radial and circumferential pressure being applied along with an upward, lateral and radially inward pull thus orienting the outer edge portion of the breast cup 18 snugly into engagement with the outer lateral portion of the breast where the breast tissues connect with the chest 22 thereby eliminating the tendency of this portion of the breast to become lodged between the outer edge portions of the breast cups and the chest cavity.

When constructing new brassieres, the shortening of the upper edge portion of the support band may be accomplished when cutting the material from which the support band is constructed. When converting an existing brassiere, the support band may be shortened by taking a dart of approximately one-half inch length beginning at the top edge and extending downwardly in a reducing width to shorten the upper edge approximately one inch and reducing the width of the dart toward the lower edge of the band. This reduction in length provides the lateral and upward pulling action thus providing lateral and upward support for the outer portions of the breast adjacent the area where the breast tissues connect with the chest.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a brassiere construction comprising a pair of breast cups, interconnected by a front body portion, a support band connected to the outer edge portions of the breast cups and body portion, shoulder straps attached to the upper edge portion of each breast cup and the rear portion of the support band, that improvement comprising the upper edge portion of the support band being shorter than the lower edge portion in a manner that lateral upward and lateral radially inward forces will be exerted on the outer edge portion of the breast cup to pull the outer edge portion of the breast cup radially inwardly toward the chest cavity and upwardly and laterally outwardly thereby providing better fit and more effective support for the outer portion of the breast where the outer tissues thereof connect with the chest area of the wearer.

2. The structure as defined in claim 1 wherein the support band is provided with a generally V-shaped area having its bottom minmum width apex generally coincident with the bottom edge of the support band where it connects with the outer edge portion of the breast cup and body portion and its maximum width at the upper edge of the support band, said V-shaped area including an inclined edge on the support band to be connected to the outer edge of the breast cup and body portion.

3. The structure as defined in claim 1 wherein the shorter length of the upper edge portion of the support band is provided by a dart taken in an existing brassiere structure with the dart having a maximum dimension at the upper edge of the support band and tapering to a lesser dimension toward the lower edge of the support band with one edge of the dart being coincident with the outer edge of the breast cup.

4. The method of effectively supporting the laterally outer portions of the breasts where the breast tissues connect with the chest cavity by the use of a brassiere consisting of the steps of constructing the brassiere with a lower circumference closely fitting the chest cavity and lower regions of the breasts, constructing a portion of the upper circumference and breast cups to fit the breasts and constructing the upper edge of the supporting band forming part of the brassiere circumference of shorter length then the lower edge thereby closely fitting and providing upward support and radially inward support for the lateral outer surfaces of the breasts along their juncture with the chest cavity.

5. The method as defined in claim 4 in which the edge of the supporting band that is attached to the outer edge of the breast cup is inclined so that when it is joined to the breast cup, it will pull the outer edge of the breast cup radially inwardly into firm supporting engagement with the laterally outer, radially inner surface areas of the breast where it is connected with the chest cavity.

6. A brassiere construction comprising a support band adapted to encircle the chest cavity of a wearer with the support band including a pair of breast cups with support shoulder straps connected to the upper edges of the breast cups and the rear portions of the support band, said support band including a seam extending from the top edge to the lower edge thereof along the outer edges of the breast cups, said seam being formed by an end portion of the support band being provided with an inclined edge extending upwardly from the lower edge of the support band in diverging relation to the edge of the breast cup whereby joining the end of the support band to the breast cup effectively shortens the upper edge portion of the support band so that inward radial force will be exerted on the edge of the breast cup to retain it in supporting engagement with the generally downwardly and inwardly curved line of juncture between the laterally outer portions of the breast and the chest cavity.

* * * * *